US005883026A

United States Patent [19]

Reader et al.

[11] Patent Number: 5,883,026

[45] Date of Patent: Mar. 16, 1999

[54] FACE MASKS INCLUDING A SPUNBONDED/ MELTBLOWN/SPUNBONDED LAMINATE

[75] Inventors: Timothy W. Reader, Suwanee; Uyles Woodrow Bowen, Jr., Canton, both of Ga.

[73] Assignee: Kimberly-Clark Worldwide, Inc., Neenah, Wis.

[21] Appl. No.: 808,509

[22] Filed: Feb. 27, 1997

[51] Int. Cl.[6] ..... B32B 5/26

[52] U.S. Cl. ..... 442/382; 128/206.12; 128/206.21; 442/381; 442/392; 442/414

[58] Field of Search ..... 442/381, 382, 442/392, 414; 128/206.12, 206.21

[56] References Cited

U.S. PATENT DOCUMENTS

| | | | |
|---|---|---|---|
| 2,868,196 | 1/1959 | Stampe | 128/146 |
| 3,082,767 | 3/1963 | Matheson | 128/146 |
| 3,276,944 | 10/1966 | Levy | 161/150 |
| 3,308,816 | 3/1967 | Franklin et al. | 128/146.2 |
| 3,338,992 | 8/1967 | Kinney | 264/24 |
| 3,341,394 | 9/1967 | Kinney | 161/72 |
| 3,502,538 | 3/1970 | Petersen | 161/150 |
| 3,502,763 | 3/1970 | Hartmann | 264/210 |
| 3,542,615 | 11/1970 | Dobo et al. | 156/181 |
| 3,692,618 | 9/1972 | Dorschner et al. | 161/72 |
| 3,849,241 | 11/1974 | Butin et al. | 161/169 |
| 3,985,132 | 10/1976 | Boyce et al. | 128/146.2 |
| 4,196,245 | 4/1980 | Kitson et al. | 428/198 |
| 4,340,563 | 7/1982 | Appel et al. | 264/518 |
| 4,417,575 | 9/1984 | Hilton et al. | 128/206.19 |
| 4,419,994 | 12/1983 | Hilton | 128/206.19 |
| 4,635,628 | 1/1987 | Hubbard et al. | 128/201.17 |
| 4,662,005 | 5/1987 | Grier-Idris | 2/9 |
| 4,688,566 | 8/1987 | Boyce | 128/206.19 |
| 4,720,415 | 1/1988 | VanderWielen et al. | 428/152 |
| 4,807,619 | 2/1989 | Dyrud et al. | 128/206.16 |
| 4,941,479 | 7/1990 | Hubbard et al. | 128/206.13 |
| 5,169,706 | 12/1992 | Collier, IV et al. | 428/152 |
| 5,213,881 | 5/1993 | Timmons et al. | 428/224 |
| 5,226,992 | 7/1993 | Morman | 156/62.4 |
| 5,244,482 | 9/1993 | Hassenboehler, Jr. et al. | 55/528 |
| 5,401,446 | 3/1995 | Tasi et al. | 264/22 |
| 5,467,765 | 11/1995 | Maturaporn | 128/206.19 |
| 5,482,765 | 1/1996 | Bradley et al. | 428/286 |
| 5,561,863 | 10/1996 | Carlson, II | 2/206 |
| 5,597,647 | 1/1997 | Powers | 442/382 |
| 5,616,408 | 4/1997 | Oleszczuk et al. | 442/346 |
| 5,695,849 | 12/1997 | Shawver et al. | 428/131 |

FOREIGN PATENT DOCUMENTS

| | | |
|---|---|---|
| 803714 | 1/1969 | Canada . |
| 0391725A1 | 10/1990 | European Pat. Off. . |
| 0754796A1 | 1/1997 | European Pat. Off. . |
| 96/38620 | 12/1996 | WIPO . |

OTHER PUBLICATIONS

"Manufacture of Superfine Organic Fibers", by V. A. Wente et al., Navy Research Laboratory, Washington, D.C., NRL Report 4364 (111437), May 25, 1994, US Dept. of Commerce, Office of Technical Services.

"An Improved Device for the Formation of Superfine, Thermoplastic Fibers", by Lawrence et al., NRL Report 5265, Feb. 11, 1959, US Dept. of Commerce, National Technical Information Service.

*Flex Shield*; Author: Splash Shield, Mar. 1996 (one double–sided brochure).

ProCare, Inc., Apr. 1, 1997; Top view and bottom view photographs of surgical mask.

*Primary Examiner*—James J. Bell

*Attorney, Agent, or Firm*—Jones & Askew, LLP; Nancy M. Klembus

[57] ABSTRACT

The present invention is directed to novel face masks, which include a spunbonded/meltblown/spunbonded (SMS) laminate. The face masks of the present invention may include other layers, in addition to the SMS layer, such as an electret meltblown layer, a spunbonded layer, a wet-laid layer or a second SMS laminate. In one embodiment, the face mask includes an outermost SMS layer, an intermediate electret meltblown layer, and an innermost layer in the form of a spunbonded layer, a wet-laid layer or a second SMS laminate.

12 Claims, No Drawings

FACE MASKS INCLUDING A SPUNBONDED/MELTBLOWN/SPUNBONDED LAMINATE

FIELD OF THE INVENTION

The present invention is directed to novel face masks containing one of more layers of fibrous material, wherein the outermost layer is a spunbonded/meltblown/spunbonded laminate. The face masks of the present invention provide liquid strike-through protection, breathability, and comfort for the wearer.

BACKGROUND OF THE INVENTION

As is generally known, face masks have been designed to greatly reduce, if not prevent, the transmission of liquids and/or airborne contaminates through the face mask. In surgical procedure environments, such liquid sources include the a patient's perspiration, patient liquids, such as blood, and life support liquids such as plasma and saline. Examples of airborne contaminates include, but are not limited to, biological contaminates, such as bacteria, viruses and fungal spores. Such contaminates may also include particulate material such as, but not limited to, lint, mineral fines, dust, skin squames and respiratory droplets. A measure of a fabrics ability to prevent the passage of such airborne materials is sometimes expressed in terms of "filtration efficiency".

Many face masks were originally made of cotton or linen. Such face masks fashioned from these materials, however, permitted transmission or "strike-through" of various liquids encountered in surgical procedures. In these instances, a path was established for transmission of biological contaminates, either present in the liquid or subsequently contacting the liquid, through the face mask. Additionally, in many instances face masks fashioned from cotton or linen provide insufficient barrier protection from the transmission therethrough of airborne contaminates. Furthermore, these articles were costly, and of course laundering and sterilization procedures were required before reuse.

Disposable face masks have largely replaced linen face masks. Advances in such disposable face masks include the formation of such articles from totally liquid repellent fabrics and/or apertured films which prevent liquid strike-through. In this way, biological contaminates carried by liquids are prevented from passing through such fabrics. However, in some instances, face masks formed from apertured films, while being liquid and airborne contaminate impervious, are, or can become over a period of time, uncomfortable to wear. Furthermore, such face masks are relatively more costly than face masks containing only nonwoven webs.

In some instances, face masks fashioned from liquid repellent fabrics, such as fabrics formed from nonwoven polymers, sufficiently repel liquids and are more breathable and thus more comfortable to the wearer than nonporous materials. However, these improvements in comfort and breathability provided by such nonwoven fabrics have generally occurred at the expense of barrier properties or filtration efficiency.

One type of nonwoven fabric, a conventional spunbonded/meltblown/spunbonded (SMS) laminate, has been widely used in surgical garments, such as gowns and drapes, due to its excellent barrier properties and relatively low cost. To date, such SMS laminates have not been used in commercially available face masks due to their unacceptable breathability properties. Consequently, the search for face mask materials, which will provide liquid strike-through protection, breathability, and comfort at a relatively low cost, continues.

Therefore, there exists a need in the art for face masks and methods for making the same, which provide improved liquid strike-through protection, breathability, and comfort, as well as, improved filtration efficiency. Such improved materials and methods are provided by the present invention and will become more apparent upon further review of the following specification and claims.

SUMMARY OF THE INVENTION

The present invention is directed to a novel face mask comprising a spunbonded/meltblown/spunbonded (SMS) laminate. The present invention is also directed to a novel face mask having an outermost layer in the form of a SMS laminate. In addition to the SMS layer, the face masks of the present invention may include an intermediate layer desirably in the form of one or more electret meltblown fabrics, and an innermost layer desirably in the form of a spunbonded fabric or a second SMS laminate.

The face masks of the present invention provide improved liquid strike-through protection, breathability, and comfort, as well as, improved filtration efficiency, while avoiding the use of expensive components such as apertured films. The face masks of the present invention include various layers, each of which provide desired characteristics and contribute to the overall filtration properties of the face masks. In fact, the various layers of the face masks synergistically work together to provide filtration properties, such as improved liquid strike-through, properties unattainable by use of any one layer of the face masks.

The face masks of the present invention can be made from a variety of materials, in addition to the SMS laminate, including, but not limited to, woven fabrics, nonwoven fabrics, knit fabrics, and combination thereof. Desirably, the face masks of the present invention are formed from a SMS laminate and one or more additional layers of nonwoven fabric. More desirably, the face masks comprise an outer SMS laminate and at least one filter fabric in the form of an electret meltblown fabric. Most desirably, the face masks comprise an outer SMS laminate, at least one intermediate filter fabric in the form of an electret meltblown fabric, and an innermost layer in the form of a spunbonded fabric, wet-laid fabric or a second SMS laminate.

The fibrous material used to form the webs above include synthetic fibers, natural fibers, and combinations thereof. The choice of fibers depends upon, for example, fiber cost and the desired properties, e.g., liquid resistance, vapor permeability or liquid wicking, of the finished face mask. For example, suitable fibrous materials may include, but are not limited to, synthetic fibers such as those derived from polyolefins, polyesters, polyamides, polyacrylics, etc., alone or in combination with one another. Similarly, natural fibers such as cotton, linen, jute, hemp, cotton, wool, wood pulp, etc.; regenerated cellulosic fibers such as viscose rayon and cuprammonium rayon; or modified cellulosic fibers, such as cellulose acetate may likewise be used. Blends of one or more of the above fibers may also be used if so desired.

It has been found that face masks formed from synthetic fibers, alone or in combination with natural fibers, are particularly well-suited for the face masks of the present invention.

The face masks of the present invention satisfy the need in the art for suitable face masks, which provide improved liquid strike-through protection, breathability and comfort, as well as, improved filtration efficiency. A detailed description of the face masks of the present invention is provided below.

DETAILED DESCRIPTION OF THE INVENTION

The face masks of the present invention include a flexible body portion, which has a generally rectangular or square shape and comprises filtration material. The filtration material is desirably one or more layers of nonwoven air permeable material. At least one layer is formed from a spunbonded/meltblown/spunbonded (SMS) laminate. Desirably, the SMS laminate is provided as an outermost layer, or cover sheet, of the face mask. In further embodiments, the SMS cover sheet is combined with an intermediate layer, which provides additional filtration properties to the face mask, and an inner layer which is in contact with and provides comfort to the face of the wearer. In a preferred embodiment, the body portion includes an outermost layer of a SMS laminate, an intermediate layer of an electret meltblown material and an inner layer of a nonwoven fabric. Desirably, the inner layer is a cover stock, such as that formed from a cellulosic material or a cellulosic material in combination with synthetic fibers; a spunbonded fabric; or a second SMS laminate. Each of the layers of body portion is generally rectangular and desirably coextensive with the other layers; however, outermost layer, or any other layer, may be oversized and adapted to be folded over one or more other layers.

The face masks of the present invention can be made from a variety of substrates in addition to the SMS laminate, including, but not limited to, woven fabrics, nonwoven fabrics, scrims, knit fabrics, and combination thereof. Desirably, the face masks of the present invention are formed from one or more nonwoven fabric layers. In the case of multiple layers, the layers are generally positioned in a juxtaposed or surface-to-surface relationship and all or a portion of the layers may be bound to adjacent layers. In the case of nonwoven fabrics, the nonwoven fabric may also be formed from a plurality of separate nonwoven webs wherein the separate nonwoven webs are similar or different from one another.

As used herein, the term "nonwoven fabric" refers to a fabric that has a structure of individual fibers or filaments which are randomly and/or unidirectionally interlaid in a mat-like fashion. Nonwoven fabrics can be made from a variety of processes including, but not limited to, air-laid processes, wet-laid processes, hydroentangling processes, staple fiber carding and bonding, and solution spinning. Suitable nonwoven fabrics include, but are not limited to, spunbonded fabrics, meltblown fabrics, wet-laid fabrics and combinations thereof.

As used herein, the term "spunbonded fabric" refers to a web of small diameter fibers and/or filaments which are formed by extruding a molten thermoplastic material, or coextruding more than one molten thermoplastic material, as filaments from a plurality of fine, usually circular, capillaries in a spinnerette with the diameter of the extruded filaments then being rapidly reduced, for example, by non-eductive or eductive fluid-drawing or other well known spunbonding mechanisms. The production of spunbonded nonwoven webs is illustrated in patents such as Appel, et al., U.S. Pat. No. 4,340,563; Dorschner et al., U.S. Pat. No. 3,692,618; Kinney, U.S. Pat. Nos. 3,338,992 and 3,341,394; Levy, U.S. Pat. No. 3,276,944; Peterson, U.S. Pat. No. 3,502,538; Hartman, U.S. Pat. No. 3,502,763; Dobo et al., U.S. Pat. No. 3,542,615; and Harmon, Canadian Patent No. 803,714.

As used herein, the term "meltblown fabrics" refers to a fabric comprising fibers formed by extruding a molten thermoplastic material through a plurality of fine, usually circular, die capillaries as molten threads or filaments into a high velocity gas (e.g. air) stream which attenuates the filaments of molten thermoplastic material to reduce their diameters, which may be to microfiber diameter. Thereafter, the meltblown fibers are carried by the high-velocity gas stream and are deposited on a collecting surface to form a web of randomly disbursed meltblown fibers. The meltblown process is well-known and is described in various patents and publications, including NRL Report 4364, "Manufacture of Super-Fine Organic Fibers" by V. A. Wendt, E. L. Boone, and C. D. Fluharty; NRL Report 5265, "An Improved device for the Formation of Super-Fine Thermoplastic Fibers" by K. D. Lawrence, R. T. Lukas, and J. A. Young; and U.S. Pat. No. 3,849,241 issued Nov. 19, 1974, to Buntin, et al.

As used herein, the term "microfibers" means small diameter fibers having an average diameter not greater than about 100 microns, for example, having a diameter of from about 0.5 microns to about 50 microns. More specifically microfibers may also have an average diameter of from about 1 micron to about 20 microns. Microfibers having an average diameter of about 3 microns or less are commonly referred to as ultra-fine microfibers.

As used herein, the term "wet-laid fabrics" refers to fabrics formed by a process, such as a paper-making process, wherein fibers dispersed in a liquid medium are deposited onto a screen such that the liquid medium flows through the screen, leaving a fabric on the surface of the screen. Fiber bonding agents may be applied to the fibers in the liquid medium or after being deposited onto the screen. Wet-laid fabrics may contain natural and/or synthetic fibers.

As used herein, the term "spunlaced fabrics" refers to a web of material consisting of a blend of natural fibers and synthetic fibers, where the fibers are subjected to high-velocity water jets which entangle the fibers to achieve mechanical bonding. Desirably, the natural fibers are wood pulp fibers and the synthetic fibers are polyester fibers.

The face masks of the present invention comprise a spunbonded/meltblown/spunbonded (SMS) laminate. Desirably, the face masks of the present invention comprise a SMS laminate as an outermost layer of the face mask. More desirably, the face masks comprise an SMS laminate as an outermost layer and at least one filter fabric in the form of an electret meltblown fabric. Most desirably, the face masks comprise an SMS laminate as an outermost layer and at least one filter fabric in the form of an electret meltblown fabric.

As used herein, the terms "electret" or "electreting" means a treatment that imparts charges to a dielectric material such as polyolefins. The charge includes layers of positive or negative charges trapped at or near the surface of of the polymer, or charge clouds stored in the bulk of the polymer. The charge also includes polarization charges which are frozen in alignment of the dipoles of the molecules. Methods of subjecting a material to electreting are well known by those skilled in the art. These methods include, for example, thermal, liquid-contact, electron beam and corona discharge methods. One particular technique of subjecting a material to electrostatic electreting is the technique disclosed in U.S. Pat. No. 5,401,466, and is herein incorporated in its entirety by reference. This technique involves subjecting a material to a pair of electrical fields wherein the electrical fields have opposite polarities.

The fibrous material used to form the fabrics above include synthetic fibers, natural fibers, and combinations thereof. The choice of fibers depends upon, for example, fiber cost and the desired properties, e.g., liquid resistance, vapor permeability or liquid wicking, of the finished drape. For example, suitable fibrous materials may include, but are not limited to, synthetic fibers such as those derived from polyolefins, polyesters, polyamides, polyacrylics, etc., alone or in combination with one another. Monocomponent and multicomponent, or conjugate, synthetic fibers may be used alone or in combination with other fibers. Other suitable fibers include natural fibers such as cotton, linen, jute, hemp, cotton, wool, wood pulp, etc. Similarly, regenerated cellulosic fibers such as viscose rayon and cuprammonium rayon, or modified cellulosic fibers, such as cellulose acetate, may likewise be used. Blends of one or more of the above fibers may also be used if so desired.

Monocomponent and conjugate synthetic fibers suitable for the present invention can be produced from a wide variety of thermoplastic polymers that are known to form fibers. Suitable polymers for forming the drapes of the present invention include, but are not limited to, polyolefins, e.g., polyethylene, polypropylene, polybutylene, and the like; polyamides, e.g., nylon 6, nylon 6/6, nylon 10, nylon 12 and the like; polyesters, e.g., polyethylene terephthalate, polybutylene terephthalate and the like; polycarbonates; polystyrenes; thermoplastic elastomers, e.g., ethylenepropylene rubbers, styrenic block copolymers, copolyester elastomers and polyamide elastomers and the like; fluoropolymers, e.g., polytetrafluoroethylene and polytrifluorochloroethylene; vinyl polymers, e.g., polyvinyl chloride, polyurethanes; and blends and copolymers thereof. Particularly suitable polymers for forming the drapes of the present invention are polyolefins, including polyethylene; polypropylene; polybutylene; and copolymers as well as blends thereof. Of the suitable polymers for forming conjugate fibers, particularly suitable polymers for the high melting component of the conjugate fibers include polypropylene, copolymers of polypropylene and ethylene and blends thereof, more particularly polypropylene, and particularly suitable polymers for the low melting component include polyethylenes, more particularly linear low density polyethylene, high density polyethylene and blends thereof; and most particularly suitable component polymers for conjugate fibers are polyethylene and polypropylene.

Suitable fiber forming polymers may additionally have thermoplastic elastomers blended therein. In addition, the polymer components may contain additives for enhancing the crimpability and/or lowering the bonding temperature of the fibers, and enhancing the abrasion resistance, strength and softness of the resulting webs. For example, the low melting polymer component may contain about 5 to about 20% by weight of a thermoplastic elastomer such as an ABA' block copolymer of styrene, ethylenebutylene and styrene. Such copolymers are commercially available and some of which are identified in U.S. Pat. No. 4,663,220 to Wisneski et al. An example of highly suitable elastomeric block copolymers is KRATON G-2740. Another group of suitable additive polymers is ethylene alkyl acrylate copolymers, such as ethylene butyl acetate, ethylene methyl acrylate and ethylene ethyl acrylate, and the suitable amount to produce the desired properties is from about 2 wt. % to about 50 wt. %, based on the total weight of the low melting polymer component. Yet other suitable additive polymers include polybutylene copolymers and ethylene-propylene copolymers.

The face masks of the present invention may be formed from fabrics containing a blend of synthetic fibers and natural fibers. Desirably, the face masks are formed from fabrics containing synthetic fibers in an amount from about 100 to 25 weight percent and natural fibers in an amount from about 0 to 75 weight percent based on the total weight of the fabric. More desirably, the face masks are formed from fabrics containing synthetic fibers in an amount from about 100 to 50 weight percent and natural fibers in an amount from about 0 to 50 weight percent based on the total weight of the fabric. Most desirably, the face masks are formed from fabrics containing synthetic fibers in an amount from about 100 to 90 weight percent and natural fibers in an amount from about 0 to 10 weight percent based on the total weight of the fabric.

It has been found that nonwovens formed from synthetic fibers, alone or in combination with natural fibers, are particularly well-suited for the face masks of the present invention. In particular, synthetic fibers containing a polyolefin are especially suitable for the face masks. Desirably, the polyolefin fibers are polypropylene or polyethylene fibers. Most desirably, the fibers are polypropylene fibers.

The face masks of the present invention include a SMS laminate, which provides desirable properties to the face mask. The SMS laminate of the present invention provides improved liquid strike-through protection, as well as, breathability. When used as an outermost layer, the SMS laminate provides a first amount of liquid strike-through protection. Although the SMS laminate is not liquid impervious, the SMS laminate provides a first amount of liquid strike-through protection, such that when combined with other conventional liquid pervious face mask layers, such as an electret meltblown fabric, acts as a liquid impervious composite. The SMS laminate is formed by well known methods, as disclosed in U.S. Pat. No. 5,213,881, issued to Timmons et al. and assigned to Kimberly-Clark Worldwide, the disclosure of which is herein incorporated by reference; however, in order to produce a SMS laminate with improved breathability, acceptable for face mask applications, a light dusting of meltblown material is formed on a surface of a spunbonded fabric using one meltblown station, as opposed to multiple meltblown stations. Desirably, the SMS laminate has a basis weight of less than about 1.5 ounces per square yard (osy). More desirably, the SMS laminate has a basis weight of less than about 1.25 osy. Most desirably, the SMS laminate has a basis weight of about 0.7 osy to about 1.25 osy. Desirably, the meltblown layer of the SMS laminate has a basis weight of less than about 0.3 ounces per square yard (osy). More desirably, the meltblown layer of the SMS laminate has a basis weight of less than about 0.2 osy. Most desirably, the meltblown layer of the SMS laminate has a basis weight of about 0.1 osy to about 0.15 osy.

The SMS laminate of the face masks may also be treated with various chemicals in order to impart desirable characteristics. For example, the SMS laminate may be treated with chemicals in order to enhance the liquid repellency of the SMS laminate. Chemicals for enhancing liquid repellency of nonwoven fabrics are well known in the art, and any such chemical is suitable for the present invention as long as the chemical does not negatively impact the breathability of the SMS laminate. Particularly useful chemicals include, but are not limited to, fluorochemicals, such as Zonyl FTS manufactured by E.I. DuPont de Nemours & Company, Wilmington, Del. The SMS laminate may also be treated with any known antistatic agent.

Desirably, the face masks of the present invention include an outermost layer in the form of a SMS laminate. In a desired embodiment, at least one meltblown layer is in contact with the SMS laminate. Desirably, the meltblown layer is an electret meltblown. Typically, the electret meltblown layer has a basis weight of less than about 1.5 osy so that overall breathability of the face mask is maintained at an acceptable level (According to military standards, a pressure drop of less than 5 mm $H_2O$ per $cm^2$ constitutes an acceptable level of breathability). Desirably, the electret meltblown layer has a basis weight of less than about 1.0 osy. More desirably, the electret meltblown layer has a basis weight of about 0.4 osy to about 0.8 osy. As discussed above, the SMS laminate alone provides a first amount of liquid strike-through protection. When combined with an electret meltblown fabric layer, the combined layers provide complete liquid strike-through protection as measured by the Nelson Blood Penetration Test (hereafter, the "Nelson Test"), even though the dusted SMS laminate or the electret meltblown layer described above taken alone will not pass the above test.

In a further embodiment, the face masks of the present invention include an outermost SMS laminate, an intermediate electret meltblown fabric, and an innermost layer for contacting the face of the wearer. The innermost layer provides comfort to the wearer and may also provide properties such as anti-wicking, liquid repellancy, and particulate filtration. Desirable innermost layers include, but are not limited to, a cover stock, such as that formed from a cellulosic material or a cellulosic material in combination with synthetic fibers; a spunbonded fabric; or a second SMS laminate. In one preferred embodiment, the innermost layer comprises a second SMS laminate having a basis weight of less than about 1.25 osy; more desirably, less than about 1.0 osy; and most desirably, from about 0.7 osy to about 1.0 osy.

The body portion of the face mask, formed from filtration material, has an upper edge or edge portion, a lower edge or edge portion, and two opposed sides or side edge portions. The body portion of the mask may also be provided with several folds or pleats, desirably from 1 to 5 pleats, arranged substantially parallel to the upper edge of the generally rectangular body portion. Additionally, the mask may be folded to form horizontal pleats, which unfold when slipped over the face of the wearer to provide sufficient room and adapt to the facial features of the wearer. Alternatively, the mask may contain vertical pleats, arranged substantially parallel to the two opposed edges of the generally rectangular body portion.

In most embodiments, the layers of the body portion will be laminated to one another such that there will be little tendency to separate or tear, particularly at the edges of the body portion. In some embodiments, it may be desired to employ at least one binding strip along the bottom and side edge portions or along all of the edge portions of the mask to reduce any tendency which may exist for the layers to separate or the body portion to tear. The binding strip may be formed from a strip or strips of material, desirably nonwoven material, folded along their longitudinal axes. The edge portions of the mask are then placed within the fold and the binding strip either sewn or adhesively secured to the edge portions.

The upper or top edge portion of the body portion of filtration material generally includes a binding strip of the type described immediately above. That is, the binding strip is formed from a strip of nonwoven material which is folded on its longitudinal axis such that the fold receives the porow pad and is suitably secured therein, either with adhesive means or by stitching through both outer surfaces of the binding strip and the intermediate filtration material. As an alternative to placing the body portion within the fold formed in a binding strip, the latter may be secured on one surface of the body portion by use of adhesive means or sewing the strip to the body portion.

Means for fixing the mask to or retaining the mask on the head of a wearer may be provided at the upper edge and lower edge portions of the mask. This may take the form of separate tie strips secured to the upper edge and lower edge of the mask at the sides of the mask. The tie strips may be secured directly to the body portion or to binding strip affixed on or partly enclosing the upper edge portion and the lower edge portion. Alternatively, the affixing means may take the form of an oversized length of binding strip of the same material and width as the binding strip described above, which may be used such that the strip, when symmetrically placed, has a length extending laterally well beyond the side edges of the body portion, providing thereby ends of the binding strip equivalent to tie strips, which may be tied behind the head of the wearer. Generally, a length of binding strip on the order of about 25 to 33 inches in length, is suitable on a mask which has dimensions of approximately 6 inches on a side. Like the binding strip, this last described embodiment, employing extended ends which serve as tie strips, may be arranged such that the filtration material is secured within the fold of the binding strip or the binding strip may be secured to the top edge and lower edge portions of the body portion by stitching the binding strip to the body in contact with either surface of the body portion.

Another embodiment includes securing separate tie strips at or adjacent the upper edge and lower edge portions to a binding formed by using either an outer layer or an inner layer having dimensions larger than the other layers of the substantially rectangular pad of filtering material. The oversized layer may be folded back upon itself to receive the remaining layers within the fold formed in the oversized layer. All layers may then be secured at their edge portions, either with suitable adhesive means placed between the overlapping folded edge portion and the surface which it adheringly contacts or by stitching through the edge portions of the layers and the folded overlapping portion. Whether the tie strips used as means for affixing the mask to the head of a wearer are formed from an oversized strip of binding material or attached separately, when formed from folded material, the fold in the tie strip is, preferably, sewn or adhesively closed.

Although the face masks described above have a substantially square or rectangular body portion and are attached to a wearer by as many as four tie strips, other face mask designs are within the scope of the present invention. One suitable face mask design is disclosed in U.S. Pat. No. 4,662,005, assigned to Kimberly-Clark Corporation, wherein the face mask has a cup or pouch-like configuration, which engages with a wearer's chin and also has two tie strings on opposite sides of an upper edge for tieing around a wearer's head. Other designs are also within the scope of the present invention.

A nose piece may also be provided at the upper edge portion of the body portion of the face mask with a thin strip of bendable or deformable material such as, for instance, aluminum or thin gauge steel. The nose piece may be enclosed within the fold of the binding strip and maintained in position between the fold and stitching formed through the binding strip or those portions of the body portion serving as the binding strip and the upper edge portions of the body portion. Alternatively, the nose piece may be secured adhesively, such as between the binding strip and the outer surface of one of the layers of the body portion. An example of how this may be accomplished is to attach the nose piece to the adhesive side of an oversized piece of pressure sensitive tape which is adhesively fixed to an outer surface of the body portion or an inner surface of a binding strip such that the metal strip is enclosed between the tape and either the body portion or binding strip. Alternatively, a double-faced pressure sensitive adhesive may be used to locate the nose piece of the positions described above. A strip of cover material or spunbonded material may then be placed over the free adhesive surface of the double faced tape. Another alternate embodiment employs the metallic nose piece strip with a self-adhering back provided by a suitable adhesive applied to a surface thereof.

The face masks of the present invention may be manufactured by any method of making face masks known to those of ordinary skill in the art. Desirably, the face masks of the present invention are made by the following process, or a variation thereof. The preformed layers of the face mask are cut to a desired shape and dimensions. The layers are joined together to form a body portion. Desirably, the layers are joined along a peripheral edge of the body portion so that breathability of the face mask is not compromised. The layers may be joined together by any known attachment means, such as sewing, adhesives, etc. A nose piece may be positioned on or between the layers of the body portion as discussed above. Desirably, one or more binder strips are used to cover and bind the edges of the layers of the body portion. The binder strips may be attached to the body portion by attachment means such as sewing, adhesives, etc. If neccesary, tie strings are attached to the upper and lower edges of the body portion.

While the focus has been directed to surgical face masks, there are many other applications for the face masks of the present invention. Other applications include, but are not limited to, laboratory applications, clean room applications, such as semi-conductor manufacture, agriculture applications, mining applications, and environmental applications.

The present invention is described above and below by way of examples, which are not to be construed in any way as imposing limitations upon the scope of the invention. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLE

Twenty five test specimens comprising an outermost layer, an intermediate layer and an innermost layer were prepared as approximately 6 inch×7 inch flat specimens. The outermost layer comprised a 1.25 osy dusted SMS laminate containing fibrous material in the form of polypropylene/polyethylene copolymer fibers (approximately 95 wt % PP and 5 wt % PE). The intermediate layer comprises a 0.6 osy electret meltblown layer containing polypropylene fibers. The innermost layer comprised a wet-laid paper layer having a basis weight of about 0.6 osy. Each test specimen was placed onto a 45 degree angle incline and the edges secured with tape to reduce the possibility of wicking. A pre-weighed 4×5 inch piece of blotter paper was placed under each test specimen and a piece of polyurethane was placed under each test specimen and blotter paper. Each test specimen was positioned 18 inches from the tip of a spray orifice of a pressurized vessel containing synthetic blood. A solenoid allowed the synthetic blood to spray through an 18 gauge needle (0.033 inch spray orifice) for a 1.0 second pulse and onto the surface of each test specimen. Five consecutive sprays were delivered to each test specimen from the spray tip. The pressure in the pressure vessel was maintained at 5.8 psig.

The 1.0 second spray was initiated 5 consecutive times onto the center portion of the test specimen. The specimen was removed, the blotter paper weighed and observed for synthetic blood penetration. Blotters were scored for synthetic blood penetration and increase in blotter weight. The backside of each test specimen was visually observed for synthetic blood penetration. The results were scored as to whether synthetic blood penetration was observed.

The results of the fluid penetration testing conducted on the twenty five face mask samples above showed no visual synthetic blood penetration. The increase in blotter weight ranged from 0.001 g to 0.035 g, the increase in weight most likely being due to moisture in the air and handling of the blotter paper.

What is claimed is:

1. A face mask comprising:

a spunbonded/meltblown/spunbonded laminate;

an innermost layer; and at least one additional filtering layer disposed intermediate the spunbonded/meltblown/spunbonded laminate and the innermost layer;

wherein the innermost layer is selected from the group consisting of a wet-laid cover stock, a spunbonded layer, and a second spunbonded/meltblown/spunbonded laminate.

2. The face mask of claim 1, wherein the spunbonded/meltblown/spunbonded laminate is an outermost layer.

3. The face mask of claim 1, wherein the at least one additional filtering layer comprises a meltblown fabric.

4. The face mask of claim 3, wherein the meltblown fabric is an electret.

5. The face mask of claim 1, wherein the SMS laminate has a basis weight of about 0.7 to about 1.25 ounces per square yard (osy).

6. The face mask of claim 3, wherein the meltblown layer has a basis weight of about 0.1 to about 0.15 ounces per square yard (osy).

7. A face mask comprising:

an outermost layer of a spunbonded/meltblown/spunbonded laminate;

an intermediate electret filtering layer; and an innermost layer, the intermediate layer disposed between the outermost layer and the innermost layer;

wherein the innermost layer is selected from the group consisting of a wet-laid cover stock, a spunbonded layer, and a second spunbonded/meltblown/spunbonded laminate.

8. The face mask of claim 7, wherein the SMS laminate has a basis weight of less than about 1.25 ounces per square yard (osy).

9. The face mask of claim 8, wherein the meltblown layer of the SMS laminate has a basis weight of less than about 0.3 ounces per square yard (osy).

10. The face mask of claim 8, wherein the spunbonded/meltblown/spunbonded laminate has a basis weight of about 0.7 to about 1.25 ounces per square yard (osy).

11. The face mask of claim 9, wherein the meltblown layer of the SMS laminate has a basis weight of about 0.1 to about 0.15 ounces per square yard (osy).

12. The face mask of claim 7, the intermediate electret filtering layer comprising at least one electret meltblown fabric layer.

* * * * *